US011011106B1

(12) United States Patent
Malhotra et al.

(10) Patent No.: US 11,011,106 B1
(45) Date of Patent: May 18, 2021

(54) SYSTEM AND METHOD FOR ERROR ADAPTATION

(71) Applicant: Samsung Display Co., Ltd., Yongin-si (KR)

(72) Inventors: Gaurav Malhotra, Cupertino, CA (US); Jalil Kamali, San Jose, CA (US)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/831,754

(22) Filed: Mar. 26, 2020

Related U.S. Application Data

(60) Provisional application No. 62/972,419, filed on Feb. 10, 2020.

(51) Int. Cl.

| | |
|---|---|
| ***G09G 5/00*** | (2006.01) |
| ***G09G 3/32*** | (2016.01) |
| ***G09G 3/3233*** | (2016.01) |
| ***G09G 3/3283*** | (2016.01) |
| ***G09G 3/3241*** | (2016.01) |

(52) U.S. Cl.
CPC ..... *G09G 3/32* (2013.01); *G09G 3/3233* (2013.01); *G09G 3/3241* (2013.01); *G09G 3/3283* (2013.01); *G09G 2300/043* (2013.01); *G09G 2320/0693* (2013.01)

(58) Field of Classification Search
CPC ..... G09G 3/32; G09G 3/3233; G09G 3/3241; G09G 3/3283; G09G 3/3291; G09G 2300/043; G09G 2320/0223; G09G 2320/0693
See application file for complete search history.

(56) References Cited

U.S. PATENT DOCUMENTS

| | | | | |
|---|---|---|---|---|
| 9,906,125 | B2 * | 2/2018 | Teh | H02M 3/157 |
| 10,013,907 | B2 * | 7/2018 | Nathan | G09G 3/2007 |
| 10,468,976 | B2 * | 11/2019 | Parette | H02M 1/38 |
| 10,699,624 | B2 * | 6/2020 | Nathan | G09G 3/2007 |
| 2011/0227906 | A1 | 9/2011 | Shirasaki et al. | |
| 2011/0254871 | A1 | 10/2011 | Yoo et al. | |
| 2013/0169699 | A1 | 7/2013 | Jeong et al. | |
| 2020/0202792 | A1 * | 6/2020 | Meng | G09G 3/3233 |
| 2021/0005144 | A1 * | 1/2021 | Long | G09G 3/3233 |

FOREIGN PATENT DOCUMENTS

| | | | |
|---|---|---|---|
| KR | 10-2006-0092716 | A | 8/2006 |
| KR | 10-2014-0076468 | A | 6/2014 |
| KR | 10-2016-0035906 | A | 4/2016 |
| KR | 10-2018-0071468 | A | 6/2018 |

* cited by examiner

*Primary Examiner* — Vijay Shankar
(74) *Attorney, Agent, or Firm* — Lewis Roca Rothgerber Christie LLP

(57) ABSTRACT

A method for compensating for characteristics of a transistor. In some embodiments, the method includes: measuring an error value, the error value being a difference between: a target current and a current driven by the transistor when the transistor is controlled by a compensated control signal based on an input control signal; adding to a first compensation parameter a first adjustment; adding to a second compensation parameter a second adjustment; and applying to a gate of the transistor a voltage equal to the sum of: the second compensation parameter, and the product of: the first compensation parameter, and an uncompensated drive voltage.

20 Claims, 7 Drawing Sheets

| | |
|---|---|
| Modified LMS<br>True gradient<br>True error | $A_{n+1} = A_n + step_A * e_n * (A_n X_n^{2.2} + 2A_n X_n^{1.1} V_{th}' + A_n V_{th}'^2 + C_n X_n^{1.1} + C_n V_{th}')$<br>$C_{n+1} = C_n + step_C * e_n * (A_n * X_n^{1.1} + A_n * V_{th}' + C_n)$ |
| Modified LMS<br>True gradient<br>Sign error | $A_{n+1} = A_n + step_A * sign(e_n) * (A_n X_n^{2.2} + 2A_n X_n^{1.1} V_{th}' + A_n V_{th}'^2 + C_n X_n^{1.1} + C_n V_{th}')$<br>$C_{n+1} = C_n + step_C * sign(e_n) * (A_n * X_n^{1.1} + A_n * V_{th}' + C_n)$ |
| Modified LMS<br>Variant 1 | $A_{n+1} = A_n + step_A * sign(e_n) * X_n^2$<br>$C_{n+1} = C_n + step_C * sign(e_n) * X_n^1$ |
| Modified LMS<br>Variant 2 | $A_{n+1} = A_n + step_A * sign(en)$<br>$C_{n+1} = C_n + step_C * sign(en) / X_n^1$ |

*FIG. 3*

SYSTEM AND METHOD FOR ERROR ADAPTATION

CROSS-REFERENCE TO RELATED APPLICATION(S)

The present application claims priority to and the benefit of U.S. Provisional Application No. 62/972,419, filed Feb. 10, 2020, entitled "NON-LINEAR SYSTEM IDENTIFICATION AND COMPENSATION USING MODIFIED LEAST MEAN SQUARE ERROR ADAPTATION ALGORITHM", the entire content of which is incorporated herein by reference.

FIELD

One or more aspects of embodiments according to the present disclosure relate to displays, and more particularly to a system and method for compensating for characteristics of a transistor in a display.

BACKGROUND

In a display having an array of pixels and a corresponding array of drive transistors, it may be advantageous to compensate for variations or changes in the characteristics of the drive transistors, using a circuit that applies compensation based on one or more compensation parameters.

Related art methods for finding suitable values for the compensation parameters may perform poorly. Thus, there is a need for an improved system and method for compensating for characteristics of a transistor.

SUMMARY

According to an embodiment of the present invention, there is provided a method for compensating for characteristics of a transistor, the method including: measuring an error value, the error value being a difference between: a target current and a current driven by the transistor when the transistor is controlled by a compensated control signal based on an input control signal; adding to a first compensation parameter a first adjustment; adding to a second compensation parameter a second adjustment; and applying to a gate of the transistor a voltage equal to the sum of: the second compensation parameter, and the product of: the first compensation parameter, and an uncompensated drive voltage, the first adjustment including a first term including a product of: a first factor, the first factor of the first term of the first adjustment being a first constant; a second factor, the second factor of the first term of the first adjustment being based on the error value; a third factor, the third factor of the first term of the first adjustment being based on the first compensation parameter; and a fourth factor, the fourth factor of the first term of the first adjustment including a term proportional to the input control signal raised to a first power, the second adjustment including a first term including a product of: a first factor, the first factor of the first term of the second adjustment being a second constant; a second factor, the second factor of the first term of the second adjustment being based on the error value; a third factor, the third factor of the first term of the second adjustment being based on the first compensation parameter; and a fourth factor, the fourth factor of the first term of the second adjustment including a term proportional to the input control signal raised to a second power, the second power being less than the first power.

In some embodiments, the first power is within 30% of 2.2.

In some embodiments, the second power is within 30% of 1.1.

In some embodiments, the difference between the first power and the second power is within 30% of 1.1.

In some embodiments, the first power is between 0 and 2.6.

In some embodiments, the second factor of the first term of the first adjustment is within 30% of the error value.

In some embodiments, the second factor of the first term of the first adjustment is within 30% of the sign of the error value.

In some embodiments, the first adjustment further includes a second term including a product of: a first factor, the first factor of the second term of the first adjustment being a third constant; a second factor, the second factor of the second term of the first adjustment being based on the error value; a third factor, the third factor of the second term of the first adjustment being based on the first compensation parameter; and a fourth factor, the fourth factor of the second term of the first adjustment including a term proportional to the input control signal raised to a third power, the third power being less than the first power.

In some embodiments, the ratio of the third constant to the first constant is within 30% of twice a nominal threshold voltage of the transistor.

In some embodiments, the first adjustment further includes a third term including a product of: a first factor, the first factor of the third term of the first adjustment being a fourth constant; a second factor, the second factor of the third term of the first adjustment being based on the error value; and a third factor, the third factor of the third term of the first adjustment being based on the first compensation parameter.

In some embodiments, the ratio of the fourth constant to the first constant is within 30% of a nominal threshold voltage of the transistor.

In some embodiments, the first adjustment further includes a fourth term including a product of: a first factor, the first factor of the fourth term of the first adjustment being a fifth constant; a second factor, the second factor of the fourth term of the first adjustment being based on the error value; a third factor, the third factor of the fourth term of the first adjustment being based on the second compensation parameter; and a fourth factor, the fourth factor of the fourth term of the first adjustment including a term proportional to the input control signal raised to a fourth power.

In some embodiments, the ratio of the fifth constant to the first constant is within 30% of 1.0.

In some embodiments, the first adjustment further includes a fifth term including a product of: a first factor, the first factor of the fifth term of the first adjustment being a sixth constant; a second factor, the second factor of the fifth term of the first adjustment being based on the error value; and a third factor, the third factor of the fifth term of the first adjustment being based on the second compensation parameter.

In some embodiments, the ratio of the sixth constant to the first constant is within 30% of a nominal threshold voltage of the transistor.

In some embodiments, the second adjustment further includes a second term including a product of: a first factor, the first factor of the second term of the second adjustment being a third constant; a second factor, the second factor of the second term of the second adjustment being based on the error value; and a third factor, the third factor of the second term of the second adjustment being based on the first compensation parameter.

In some embodiments, the ratio of the third constant to the second constant is within 30% of a nominal threshold voltage of the transistor.

In some embodiments, the second adjustment further includes a third term including a product of: a first factor, the first factor of the third term of the second adjustment being a fourth constant; a second factor, the second factor of the third term of the second adjustment being based on the error value; and a third factor, the third factor of the third term of the second adjustment being based on the second compensation parameter, wherein the ratio of the fourth constant to the second constant is within 30% of 1.0.

According to an embodiment of the present invention, there is provided a system for compensating for characteristics of a transistor, the system including a processing circuit and a memory, the memory storing instructions, that, when executed by the processing circuit, cause the processing circuit to: measure an error value, the error value being a difference between: a target current and a current driven by the transistor when the transistor is controlled by a compensated control signal based on an input control signal; add to a first compensation parameter a first adjustment; add to a second compensation parameter a second adjustment; and cause to be applied, to a gate of the transistor, a voltage equal to the sum of: the second compensation parameter, and the product of: the first compensation parameter, and an uncompensated drive voltage, the first adjustment including a first term including a product of: a first factor, the first factor of the first term of the first adjustment being a first constant; a second factor, the second factor of the first term of the first adjustment being based on the error value; a third factor, the third factor of the first term of the first adjustment being based on the first compensation parameter; and a fourth factor, the fourth factor of the first term of the first adjustment including a term proportional to the input control signal raised to a first power, the second adjustment including a first term including a product of: a first factor, the first factor of the first term of the second adjustment being a second constant; a second factor, the second factor of the first term of the second adjustment being based on the error value; a third factor, the third factor of the first term of the second adjustment being based on the first compensation parameter; and a fourth factor, the fourth factor of the first term of the second adjustment including a term proportional to the input control signal raised to a second power, the second power being less than the first power.

According to an embodiment of the present invention, there is provided a system for compensating for characteristics of a transistor, the system including means for processing configured to: measure an error value, the error value being a difference between: a target current and a current driven by the transistor when the transistor is controlled by a compensated control signal based on an input control signal; add to a first compensation parameter a first adjustment; add to a second compensation parameter a second adjustment; and cause to be applied, to a gate of the transistor, a voltage equal to the sum of: the second compensation parameter, and the product of: the first compensation parameter, and an uncompensated drive voltage, the first adjustment including a first term including a product of: a first factor, the first factor of the first term of the first adjustment being a first constant; a second factor, the second factor of the first term of the first adjustment being based on the error value; a third factor, the third factor of the first term of the first adjustment being based on the first compensation parameter; and a fourth factor, the fourth factor of the first term of the first adjustment including a term proportional to the input control signal raised to a first power, the second adjustment including a first term including a product of: a first factor, the first factor of the first term of the second adjustment being a second constant; a second factor, the second factor of the first term of the second adjustment being based on the error value; a third factor, the third factor of the first term of the second adjustment being based on the first compensation parameter; and a fourth factor, the fourth factor of the first term of the second adjustment including a term proportional to the input control signal raised to a second power, the second power being less than the first power.

BRIEF DESCRIPTION OF THE DRAWINGS

These and other features and advantages of the present disclosure will be appreciated and understood with reference to the specification, claims, and appended drawings wherein:

FIG. 3 is a table of equations, according to an embodiment of the present disclosure;

DETAILED DESCRIPTION

The detailed description set forth below in connection with the appended drawings is intended as a description of exemplary embodiments of a system and method for compensating for characteristics of a transistor provided in accordance with the present disclosure and is not intended to represent the only forms in which the present disclosure may be constructed or utilized. The description sets forth the features of the present disclosure in connection with the illustrated embodiments. It is to be understood, however, that the same or equivalent functions and structures may be accomplished by different embodiments that are also intended to be encompassed within the scope of the disclosure. As denoted elsewhere herein, like element numbers are intended to indicate like elements or features.

Figure 1:
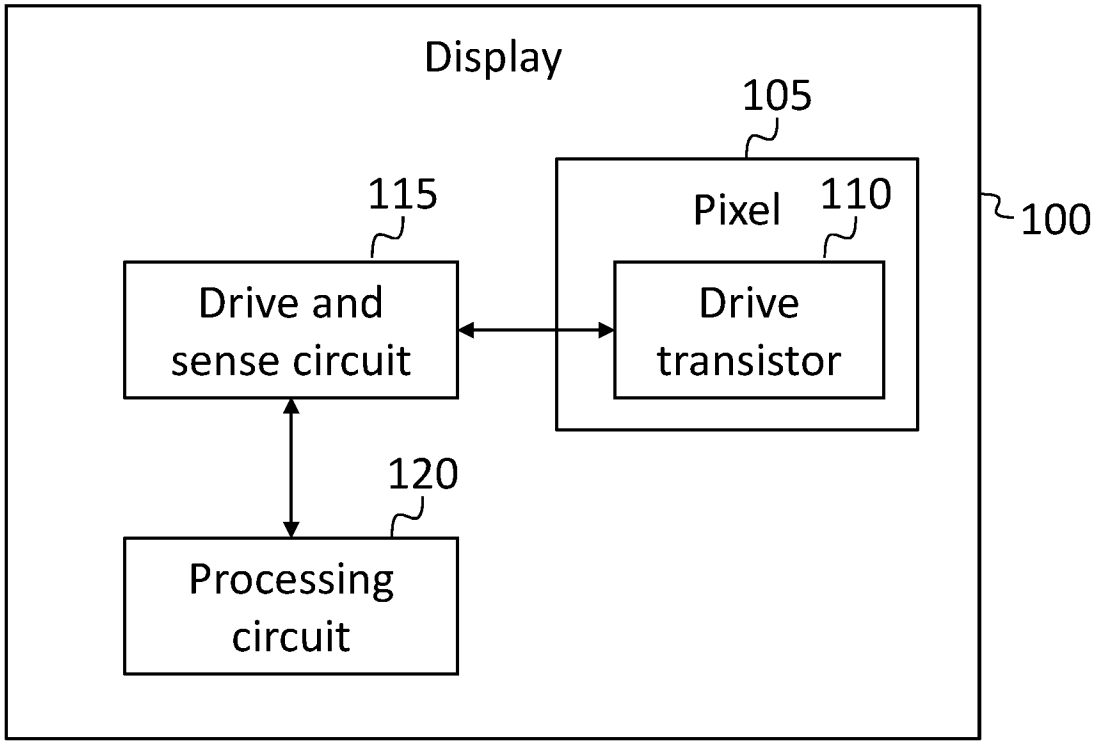
FIG. 1 is a block diagram of a display, according to an embodiment of the present disclosure.

FIG. 1 is a block diagram of a display 100, according to some embodiments. The display 100 includes an array of pixels 105 (of which one is shown) each of which includes a drive transistor 110 (e.g., for driving a current through a light emitting diode). A drive and sense circuit 115 applies a control voltage to the gate of the drive transistor 110 (e.g., in first state) and senses the resulting drive current produced by the drive transistor 110 (e.g., in a second state). The drive and sense circuit 115 may also calculate (e.g., using an analog subtraction circuit) the difference between a reference current and the drive current produced by the drive transistor 110. A processing circuit 120 may interact with the drive and sense circuit 115 to determine, and apply, suitable compensation for changes or variation in the parameters of the drive transistors 110.

Figure 2:
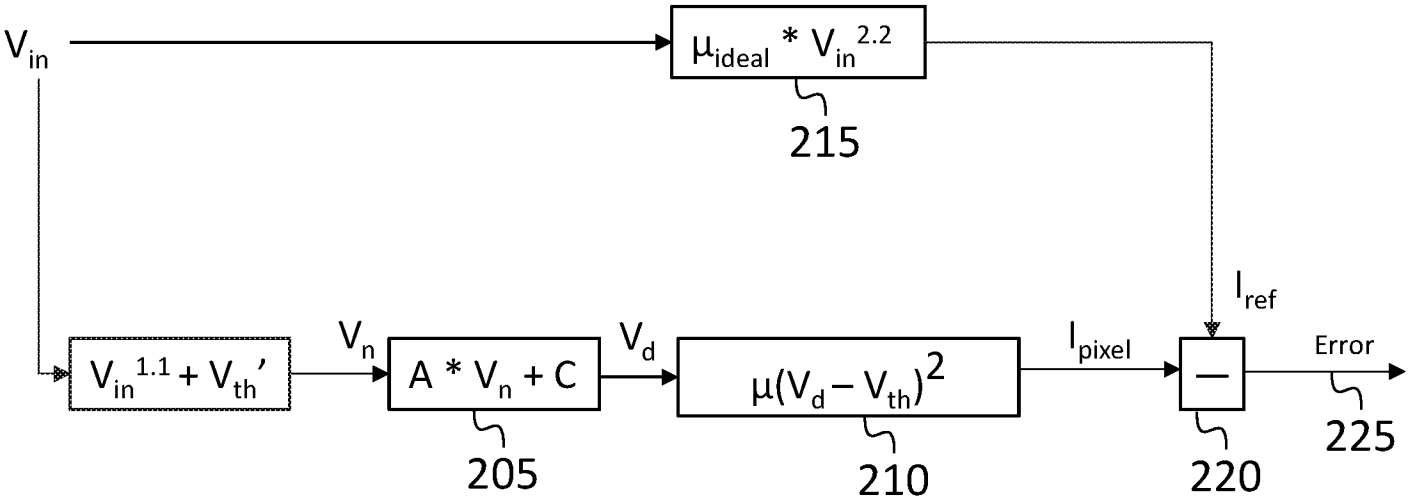
FIG. 2 is a signal flow diagram, according to an embodiment of the present disclosure.

The characteristics of drive transistors 110 (e.g., the mobility μ and threshold voltage $V_{th}$) may vary, e.g., because of fabrication differences between the drive transistors 110 or because of aging. As such, in some embodiments, the control voltage is modified to compensate for such variation. Referring to FIG. 2, in some embodiments an input control signal, e.g., an input voltage $V_{in}$, is converted at 200, to an uncompensated control voltage $V_n$ by applying a gamma correction (raising the input voltage $V_{in}$ to the power of 1.1) and adding a nominal threshold voltage $V_{th}'$, e.g., 0.7 V. The uncompensated control voltage $V_n$ is modified, at 205, with a first (multiplicative) compensation parameter A and a second (additive) compensation parameter C, to form a drive voltage Vd, which is applied to the gate of the drive transistor 110. The drive transistor then produces, at 210, a drive current $I_{pixel}$ equal to $\mu(V_d-V_{th})^2$, where μ is the carrier mobility of the drive transistor 110, and $V_{th}$ is the threshold voltage of the drive transistor 110. A reference current (or "target" current) $I_{ref}$ (calculated at 215) is subtracted, at 220, from the drive current $I_{pixel}$, to form an error value 225.

In some embodiments, the first compensation parameter A and the second compensation parameter C are adjusted, in operation, based on the measured error value. The adjustments may be made iteratively until the method converges (with an acceptably small error value). A method for performing such adjustments may be derived as follows.

The error value 225 may be given by the following equation:

$$e_n=I_{ref}-\mu(A*(V_{in}^{1.1}+V_{th}')+C-V_{th})^2$$

where the subscript n is an index that is incremented with each iteration.

The first compensation parameter A and the second compensation parameter C may then be updated as follows, using lines of steepest descent:

$$A_{n+1}=A_n-\text{step}_A*\frac{\partial en^2}{\partial An}=A_n-2*\text{step}_A*e_n*\frac{\partial en}{\partial An}$$

$$C_{n+1}=C_n-\text{step}_C*\frac{\partial en^2}{\partial Cn}=C_n-2*\text{step}_C*e_n*\frac{\partial en}{\partial Cn}$$

The partial derivative of $e_n$ with respect to $A_n$ may then be written as follows:

$$\begin{aligned}\frac{\partial en}{\partial An}&=-2*\mu(A_nV_{in}^{1.1}+A_nV_{th}'+C_n-V_{th})*(V_{in}^{1.1}+V_{th}')\\&=-2*\mu(A_nV_{in}^{2.2}+A_nV_{in}^{1.1}V_{th}'+C_nV_{in}^{1.1}-V_{in}^{1.1}V_{th}+A_nV_{in}^{1.1}V_{th}'+\\&\quad A_nV_{th}'^2+C_nV_{th}'-V_{th}V_{th}')\\&=-2*\mu(A_nV_{in}^{2.2}+2A_nV_{in}^{1.1}V_{th}'+A_nV_{th}'^2+C_nV_{in}^{1.1}+C_nV_{th}'-\\&\quad V_{in}^{1.1}V_{th}'-V_{th}V_{th}')\end{aligned}$$

Removing the last two terms ($-V_{in}^{1.1}V_{th}$ and $-V_{th}V_{th}'$), which may be sufficiently small that their removal does not affect the sign of the partial derivative, results in the following approximate expression:

$$\frac{\partial en}{\partial An}=-2*\mu(A_nV_{in}^{2.2}+2A_nV_{in}^{1.1}V_{th}'+A_nV_{in}'^2+C_nV_{in}^{1.1}+C_nV_{th}')$$

The following equation may then be used to update first compensation parameter A:

$$A_{n+1}=A_n-\text{step}_{A0}*\frac{\partial en^2}{\partial An}=A_n-2*\text{step}_{A0}*e_n*\frac{\partial en}{\partial An}$$

where the partial derivative is given by:

$$\frac{\partial en}{\partial An}=-2*\mu(A_nV_{in}^{2.2}+2A_nV_{in}^{1.1}V_{th}'+A_nV_{th}'^2+C_nV_{in}^{1.1}+C_nV_{th}').$$

For updating the second compensation parameter C, the following equation may be used:

$$\frac{\partial en}{\partial Cn}=-2*\mu(A_nV_{in}^{1.1}+A_nV_{th}'+C_n-V_{th}),$$

which may be written, when the unknown term including $V_{th}$ is neglected:

$$\frac{\partial en}{\partial Cn}=-2*\mu(A_nV_{in}^{1.1}+A_nV_{th}'+C_n).$$

The following equation may then be used to update second compensation parameter C:

$$C_{n+1}=C_n-\text{step}_{C0}*\frac{\partial en2}{\partial Cn}=C_n-2*\text{step}_{C0}*e_n*\frac{\partial en}{\partial Cn},$$

where the partial derivative is given by:

$$\frac{\partial en}{\partial Cn}=-2*\mu(A_nV_{in}^{1.1}+AV_{th}'+C_n).$$

The full equations that may be used for updating the first compensation parameter A and the second compensation parameter C are shown in the table of FIG. 3 with X representing input voltage $V_{in}$. The first row of this table shows the equations derived above (with the expressions for the partial derivatives included explicitly). It may be seen that the first compensation parameter A is adjusted at each iteration by adding to it, at each iteration, a first adjustment, the first adjustment having five terms, as follows:

$$\text{step}_A*e_n*(A_nX_n^{2.2}+2A_nX_n^{1.1}V_{th}'+A_nV_{th}'^2+C_nX_n^{1.1}+C_nV_{th}')$$

The first term of the first adjustment, for example, is $\text{step}_A*e_n*A_n X_n^{2.2}$, and the second term of the first adjustment is $\text{step}_A*e_n*2A_n X_n^{1.1}V_{th}'$. As used herein, the terms in (and the number of terms in) an expression such as that for the first adjustment is unaffected by whether it is written (i) in factored form (as above), with, e.g., common factors collected outside a sum of terms lacking common factors, or (ii) in expanded form (as a sum of terms), e.g., as follows:

$$\text{step}_A*e_n*A_nX_n^{2.2}+\text{step}_A*e_n*2A_nX_n^{1.1}V_{th}'+\text{step}_A*e_n*A_nV_{th}'^2+\text{step}_A*e_n*C_nX_n^{1.1}+\text{step}_A*e_n*C_nV_{th}'.$$

In some embodiments, the numerical values in the equation for the first adjustment may vary slightly while nonetheless allowing the method to operate in substantially the same manner. For example, the factor $X_n^{2.2}$ of the first term (in the order in which the terms are written above) of the first adjustment includes a term ($X_n^{2.2}$) proportional to the control signal raised to a first power, where the first power may be 2.2, or it may be a different number, e.g., a number within 30% of 2.2.

Similarly, the ratio of (i) the constant factor ($step_A$*2 $V_{th}$') of the second term of the first adjustment to (ii) the constant factor ($step_A$) of the first term of the first adjustment may be equal to twice the nominal threshold voltage $V_{th}$' or it may be within 30% of twice the nominal threshold voltage $V_{th}$'. As used herein, when a second number is "within Y %" of a first number, it means that the second number is at least (1−Y/100) times the first number and the second number is at most (1+Y/100) times the first number.

From the second equation in the first row of the table of FIG. 3, it may be seen that the second compensation parameter C is adjusted at each iteration by adding to it, at each iteration, a second adjustment, the second adjustment having three terms, of which, for example, the first term (in the order in which the terms are presented in the first row of the table of FIG. 3) includes a fourth factor which includes a term ($X_n^{1.1}$) proportional to the control signal raised to a second power, the second power being 1.1.

The second row of the table of FIG. 3 shows a first alternate set of equations, in which the sign of the error value is used (instead of the error value). The third row of the table of FIG. 3 shows a second alternate set of equations, in which all of the terms, except the first term of each of the first adjustment and the second adjustment, have been omitted, the first power has been rounded to 2, and the second power has been rounded to 1. An embodiment using this set of equations may have the advantage of being less computationally costly, in part because squaring a number may be significantly less burdensome than raising the number to the power of 2.2. The fourth row of the table of FIG. 3 shows a third alternate set of equations, in which the first power is zero, and the second power is −1. In the equations of the table of FIG. 3, other constants have been absorbed into the step sizes, so that, $step_A$=4μ $step_{A0}$ and $step_C$=4μ $step_{C0}$.

The initial values used for first compensation parameter A and the second compensation parameter C may be 1 and 0 respectively. The step sizes $step_A$ and $step_C$ may be selected based on sensing noise and input power (i.e., power in the current signal sensed when the transistor drive current is sensed), and may generally be selected to be inversely proportional to these two variables. The noise variance may be expected to be around 150 pA, and the square of the sensed input voltage may be expected to be about 4 $V^2$. Converting everything to the current domain results in a step size between 1 e-4 and 1e-7. Within this relatively broad range, the step size may be adjusted to achieve acceptable convergence. If the step size is too large, the sequence of adjustments may be unstable, with each adjustment overcorrecting by an amount resulting in larger error than on the previous iteration. The convergence may be slow if the step size is very small, because the adjustments are small, and the convergence may also be slow if the step size is nearly large enough to cause instability, because in such a case each adjustment may overcorrect by an amount that results in an error having a magnitude only slightly smaller than on the previous iteration.

The adjusting may be performed at each frame, or less frequently. Each time the display displays a new frame, new information is available regarding how well the compensation parameters for each pixel are performing. Adjusting each of the compensation parameters for each pixel each time a new frame is displayed may be burdensome, however, because of the large number of pixels a display may contain. As such, in some embodiments, only the compensation parameters for a subset of the pixels (e.g., the pixels in one line of the display) are updated after each frame.

Figure 4A:
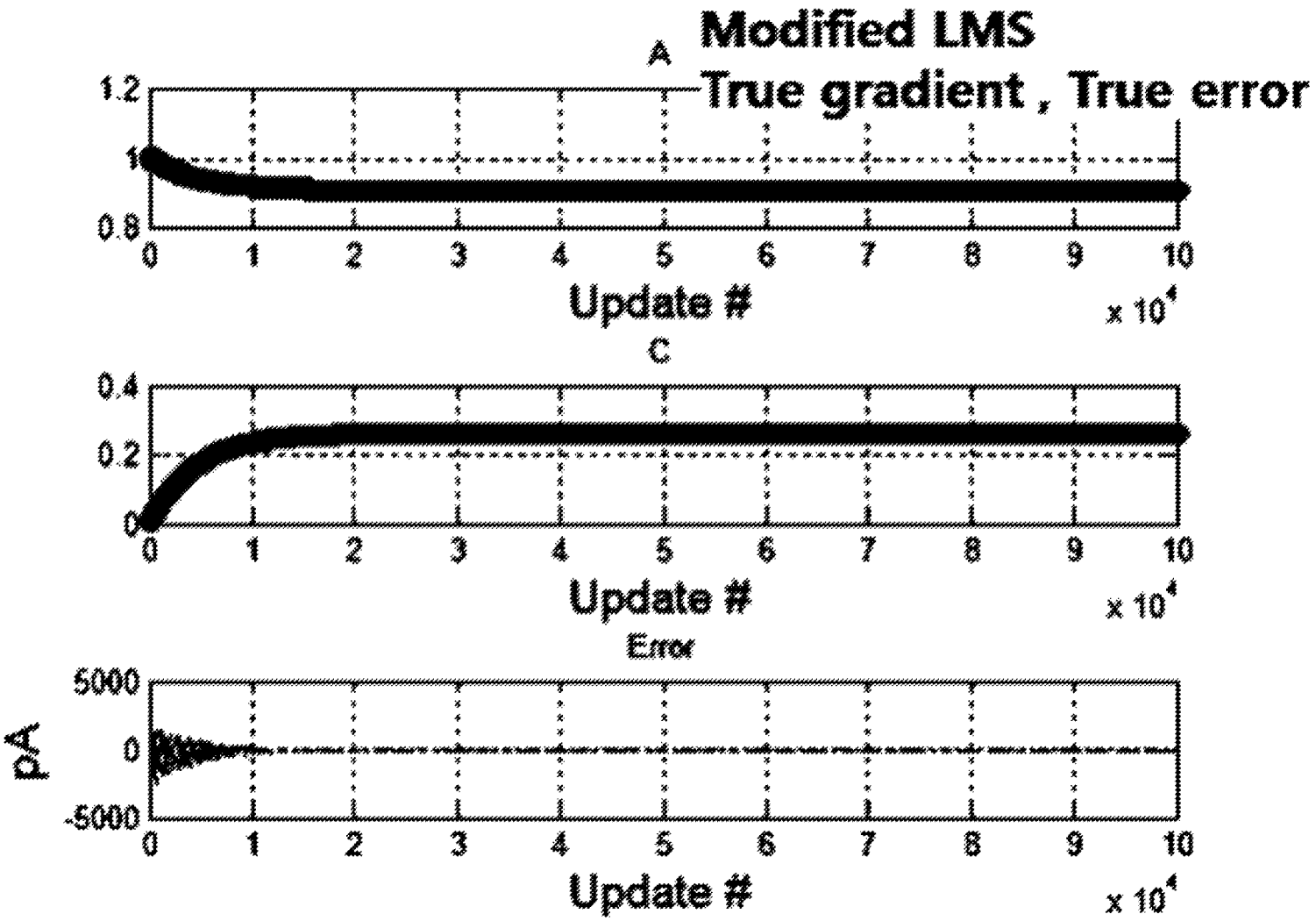
FIG. 4A is a graph of simulation results, according to an embodiment of the present disclosure.
Figure 4B:
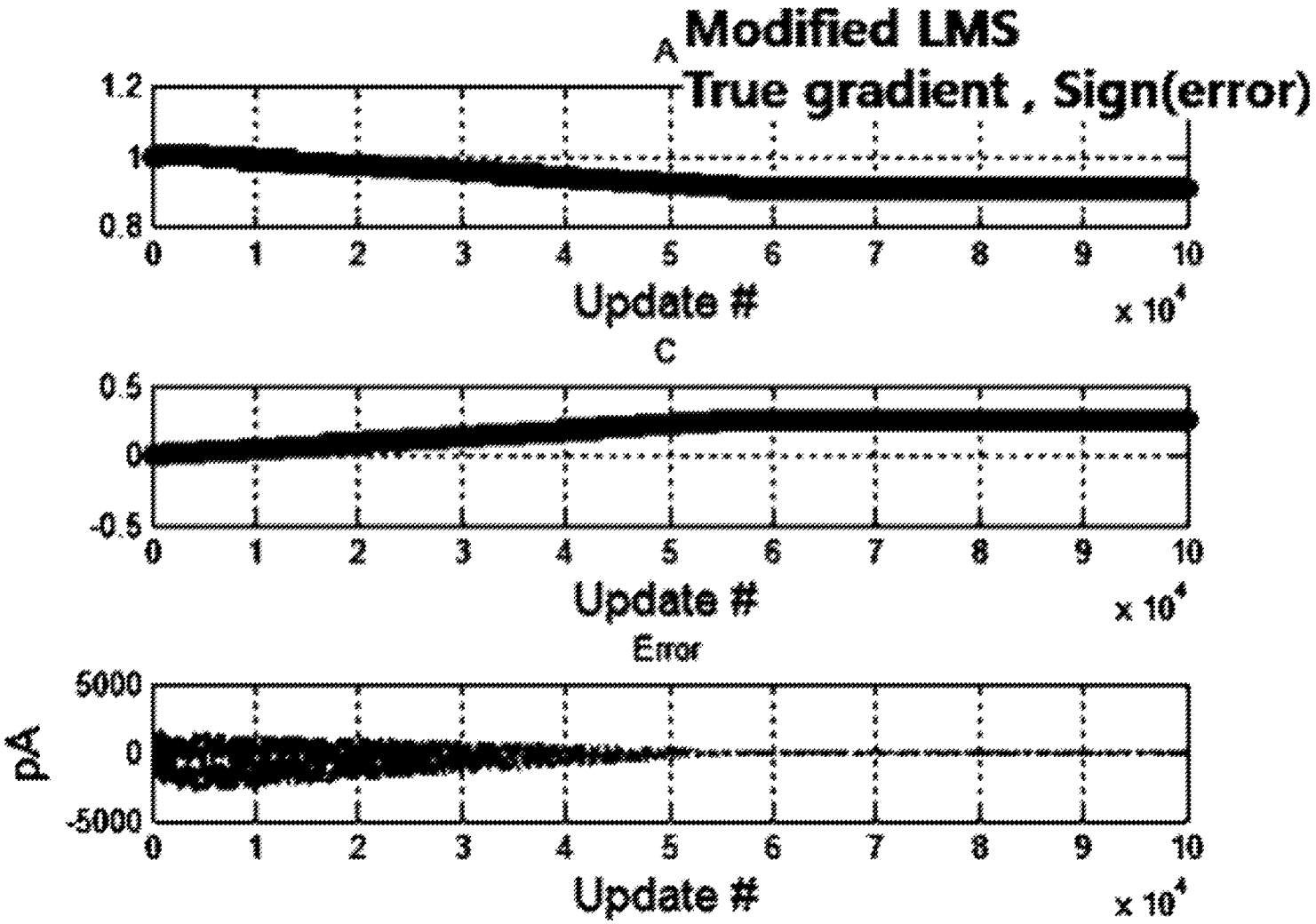
FIG. 4B is a graph of simulation results, according to an embodiment of the present disclosure.
Figure 4C:
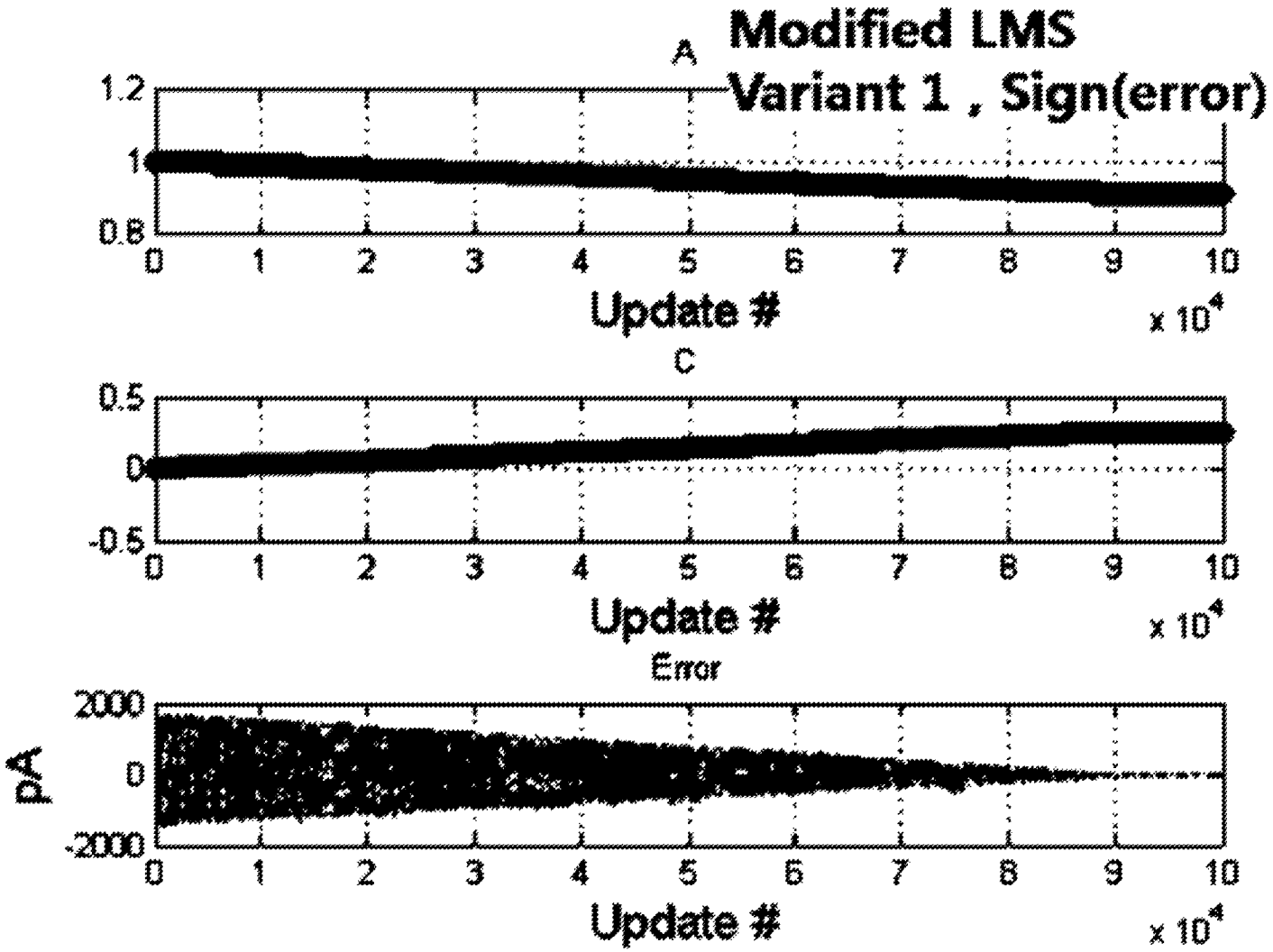
FIG. 4C is a graph of simulation results, according to an embodiment of the present disclosure.
Figure 4D:
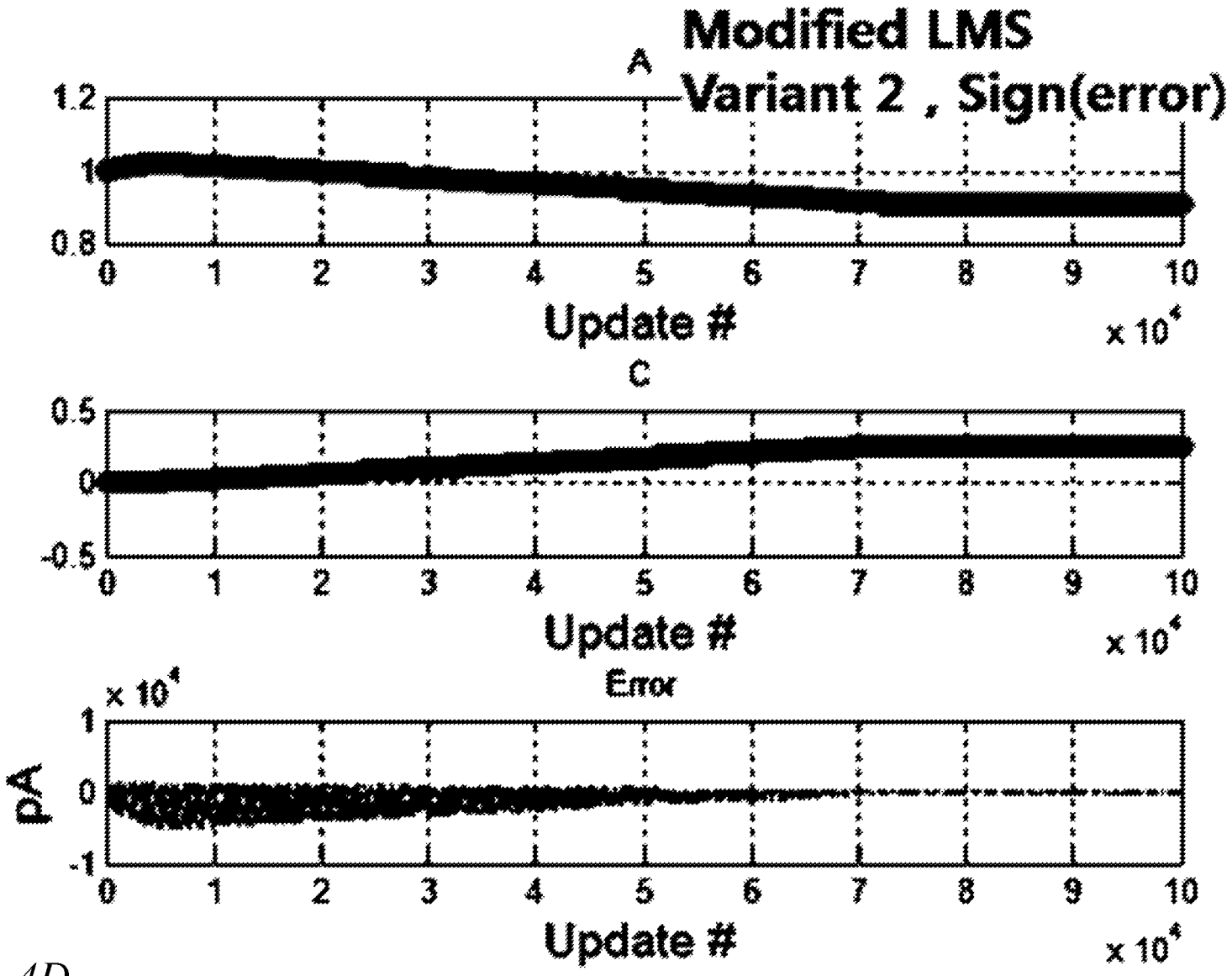
FIG. 4D is a graph of simulation results, according to an embodiment of the present disclosure.

FIGS. 4A-4B shows simulated performance, each for a respective row of the table of FIG. 3. In each of FIGS. 4A-4B, a first graph shows the first compensation parameter A as a function of update number, a second graph shows the second compensation parameter C as a function of update number, and a third graph shows the error value as a function of update number. It may be seen that the simulated performance of the embodiment corresponding to the first row of the table of FIG. 3 shows the most rapid convergence.

In the equations presented herein and in the drawings an asterisk is used interchangeably with a space between symbols to signify multiplication. As such, both "$A_n$*$X_n^{1.1}$" and "$A_n$ $X_n^{1.1}$" signify the product of $A_n$ and $X_n^{1.1}$. As used herein, the "difference between" a first number A and a second number B is equal to A-B. As used herein, the "ratio of" a first number A to a second number B is equal to A divided by B. It will be understood that the order in which factors are present in a term is immaterial and that therefor, for example, the product written $step_A$*$e_n$*$A_n$ $X_n^{2.2}$+2$A_n$ $X_n^{1.1}$ $V_{th}$' may be described as including a first factor $step_A$ and a second factor $e_n$, and it may equally well be described as including, for example, a first factor $e_n$ and a second factor $step_A$.

In some embodiments a processing circuit may perform some or all of the calculations described herein, and it may receive (through an analog to digital converter) the error value, and cause (e.g., by driving, with a suitable digital value, a digital to analog converter connected to the gate of the drive transistor) a suitable gate voltage to be applied to the drive transistor. The term "processing circuit" is used herein to mean any combination of hardware, firmware, and software, employed to process data or digital signals. Processing circuit hardware may include, for example, application specific integrated circuits (ASICs), general purpose or special purpose central processing units (CPUs), digital signal processors (DSPs), graphics processing units (GPUs), and programmable logic devices such as field programmable gate arrays (FPGAs). In a processing circuit, as used herein, each function is performed either by hardware configured, i.e., hard-wired, to perform that function, or by more general-purpose hardware, such as a CPU, configured to execute instructions stored in a non-transitory storage medium. A processing circuit may be fabricated on a single printed circuit board (PCB) or distributed over several interconnected PCBs. A processing circuit may contain other processing circuits; for example, a processing circuit may include two processing circuits, an FPGA and a CPU, interconnected on a PCB.

As used herein, the term "or" should be interpreted as "and/or", such that, for example, "A or B" means any one of "A" or "B" or "A and B". As used herein, when a method (e.g., an adjustment) or a first quantity (e.g., a first term or a first factor) is referred to as being "based on" a second quantity (e.g., a second term or a second factor) it means that the second quantity is an input to the method or influences the first quantity, e.g., the second quantity may be an input (e.g., the only input, or one of several inputs) to a function that calculates the first quantity, or the first quantity may be equal to the second quantity, or the first quantity may be the same as (e.g., stored at the same location or locations in memory) as the second quantity.

It will be understood that, although the terms "first", "second", "third", etc., may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed herein could be termed a second element, component, region, layer or section, without departing from the spirit and scope of the inventive concept.

Spatially relative terms, such as "beneath", "below", "lower", "under", "above", "upper" and the like, may be used herein for ease of description to describe one element or feature's relationship to another element(s) or feature(s) as illustrated in the figures. It will be understood that such spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly. In addition, it will also be understood that when a layer is referred to as being "between" two layers, it can be the only layer between the two layers, or one or more intervening layers may also be present.

The terminology used herein is for the purpose of describing particular embodiments only and is not intended to be limiting of the inventive concept. As used herein, the terms "substantially," "about," and similar terms are used as terms of approximation and not as terms of degree, and are intended to account for the inherent deviations in measured or calculated values that would be recognized by those of ordinary skill in the art.

As used herein, the singular forms "a" and "an" are intended to include the plural forms as well, unless the context clearly indicates otherwise. It will be further understood that the terms "comprises" and/or "comprising", when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list. Further, the use of "may" when describing embodiments of the inventive concept refers to "one or more embodiments of the present disclosure". Also, the term "exemplary" is intended to refer to an example or illustration. As used herein, the terms "use," "using," and "used" may be considered synonymous with the terms "utilize," "utilizing," and "utilized," respectively.

It will be understood that when an element or layer is referred to as being "on", "connected to", "coupled to", or "adjacent to" another element or layer, it may be directly on, connected to, coupled to, or adjacent to the other element or layer, or one or more intervening elements or layers may be present. In contrast, when an element or layer is referred to as being "directly on", "directly connected to", "directly coupled to", or "immediately adjacent to" another element or layer, there are no intervening elements or layers present.

Any numerical range recited herein is intended to include all sub-ranges of the same numerical precision subsumed within the recited range. For example, a range of "1.0 to 10.0" or "between 1.0 and 10.0" is intended to include all subranges between (and including) the recited minimum value of 1.0 and the recited maximum value of 10.0, that is, having a minimum value equal to or greater than 1.0 and a maximum value equal to or less than 10.0, such as, for example, 2.4 to 7.6. Any maximum numerical limitation recited herein is intended to include all lower numerical limitations subsumed therein and any minimum numerical limitation recited in this specification is intended to include all higher numerical limitations subsumed therein.

Although exemplary embodiments of a system and method for compensating for characteristics of a transistor have been specifically described and illustrated herein, many modifications and variations will be apparent to those skilled in the art. Accordingly, it is to be understood that a system and method for compensating for characteristics of a transistor constructed according to principles of this disclosure may be embodied other than as specifically described herein. The invention is also defined in the following claims, and equivalents thereof.

What is claimed is:

1. A method for compensating for characteristics of a transistor, the method comprising:

measuring an error value, the error value being a difference between:

a target current and a current driven by the transistor when the transistor is controlled by a compensated control signal based on an input control signal;

adding to a first compensation parameter a first adjustment;

adding to a second compensation parameter a second adjustment; and applying to a gate of the transistor a voltage equal to the sum of:

the second compensation parameter, and the product of:

the first compensation parameter, and an uncompensated drive voltage, the first adjustment comprising a first term comprising a product of:

a first factor, the first factor of the first term of the first adjustment being a first constant;

a second factor, the second factor of the first term of the first adjustment being based on the error value;

a third factor, the third factor of the first term of the first adjustment being based on the first compensation parameter; and a fourth factor, the fourth factor of the first term of the first adjustment comprising a term proportional to the input control signal raised to a first power, the second adjustment comprising a first term comprising a product of:

a first factor, the first factor of the first term of the second adjustment being a second constant;

a second factor, the second factor of the first term of the second adjustment being based on the error value;

a third factor, the third factor of the first term of the second adjustment being based on the first compensation parameter; and a fourth factor, the fourth factor of the first term of the second adjustment comprising a term proportional to the input control signal raised to a second power, the second power being less than the first power.

2. The method of claim 1, wherein the first power is within 30% of 2.2.

3. The method of claim 2, wherein the second power is within 30% of 1.1.

4. The method of claim 1, wherein the difference between the first power and the second power is within 30% of 1.1.

5. The method of claim 4, wherein the first power is between 0 and 2.6.

6. The method of claim 4, wherein the second factor of the first term of the first adjustment is within 30% of the error value.

7. The method of claim 4, wherein the second factor of the first term of the first adjustment is within 30% of the sign of the error value.

8. The method of claim 1, wherein the first adjustment further comprises a second term comprising a product of:
- a first factor, the first factor of the second term of the first adjustment being a third constant;
- a second factor, the second factor of the second term of the first adjustment being based on the error value;
- a third factor, the third factor of the second term of the first adjustment being based on the first compensation parameter; and
- a fourth factor, the fourth factor of the second term of the first adjustment comprising a term proportional to the input control signal raised to a third power, the third power being less than the first power.

9. The method of claim 8, wherein the ratio of the third constant to the first constant is within 30% of twice a nominal threshold voltage of the transistor.

10. The method of claim 8, wherein the first adjustment further comprises a third term comprising a product of:
- a first factor, the first factor of the third term of the first adjustment being a fourth constant;
- a second factor, the second factor of the third term of the first adjustment being based on the error value; and
- a third factor, the third factor of the third term of the first adjustment being based on the first compensation parameter.

11. The method of claim 10, wherein the ratio of the fourth constant to the first constant is within 30% of a nominal threshold voltage of the transistor.

12. The method of claim 10, wherein the first adjustment further comprises a fourth term comprising a product of:
- a first factor, the first factor of the fourth term of the first adjustment being a fifth constant;
- a second factor, the second factor of the fourth term of the first adjustment being based on the error value;
- a third factor, the third factor of the fourth term of the first adjustment being based on the second compensation parameter; and
- a fourth factor, the fourth factor of the fourth term of the first adjustment comprising a term proportional to the input control signal raised to a fourth power.

13. The method of claim 12, wherein the ratio of the fifth constant to the first constant is within 30% of 1.0.

14. The method of claim 12, wherein the first adjustment further comprises a fifth term comprising a product of:
- a first factor, the first factor of the fifth term of the first adjustment being a sixth constant;
- a second factor, the second factor of the fifth term of the first adjustment being based on the error value; and
- a third factor, the third factor of the fifth term of the first adjustment being based on the second compensation parameter.

15. The method of claim 14, wherein the ratio of the sixth constant to the first constant is within 30% of a nominal threshold voltage of the transistor.

16. The method of claim 1, wherein the second adjustment further comprises a second term comprising a product of:
- a first factor, the first factor of the second term of the second adjustment being a third constant;
- a second factor, the second factor of the second term of the second adjustment being based on the error value; and
- a third factor, the third factor of the second term of the second adjustment being based on the first compensation parameter.

17. The method of claim 16, wherein the ratio of the third constant to the second constant is within 30% of a nominal threshold voltage of the transistor.

18. The method of claim 17, wherein the second adjustment further comprises a third term comprising a product of:
- a first factor, the first factor of the third term of the second adjustment being a fourth constant;
- a second factor, the second factor of the third term of the second adjustment being based on the error value; and
- a third factor, the third factor of the third term of the second adjustment being based on the second compensation parameter, wherein the ratio of the fourth constant to the second constant is within 30% of 1.0.

19. A system for compensating for characteristics of a transistor, the system comprising a processing circuit and a memory, the memory storing instructions, that, when executed by the processing circuit, cause the processing circuit to:

measure an error value, the error value being a difference between:
- a target current and
- a current driven by the transistor when the transistor is controlled by a compensated control signal based on an input control signal;

add to a first compensation parameter a first adjustment;

add to a second compensation parameter a second adjustment; and cause to be applied, to a gate of the transistor, a voltage equal to the sum of:
- the second compensation parameter, and
- the product of:
  - the first compensation parameter, and
  - an uncompensated drive voltage, the first adjustment comprising a first term comprising a product of:
- a first factor, the first factor of the first term of the first adjustment being a first constant;
- a second factor, the second factor of the first term of the first adjustment being based on the error value;
- a third factor, the third factor of the first term of the first adjustment being based on the first compensation parameter; and
- a fourth factor, the fourth factor of the first term of the first adjustment comprising a term proportional to the input control signal raised to a first power, the second adjustment comprising a first term comprising a product of:
- a first factor, the first factor of the first term of the second adjustment being a second constant;
- a second factor, the second factor of the first term of the second adjustment being based on the error value;

a third factor, the third factor of the first term of the second adjustment being based on the first compensation parameter; and a fourth factor, the fourth factor of the first term of the second adjustment comprising a term proportional to the input control signal raised to a second power, the second power being less than the first power.

20. A system for compensating for characteristics of a transistor, the system comprising means for processing configured to:

measure an error value, the error value being a difference between:

a target current and a current driven by the transistor when the transistor is controlled by a compensated control signal based on an input control signal;

add to a first compensation parameter a first adjustment;

add to a second compensation parameter a second adjustment; and cause to be applied, to a gate of the transistor, a voltage equal to the sum of:

the second compensation parameter, and the product of:

the first compensation parameter, and an uncompensated drive voltage, the first adjustment comprising a first term comprising a product of:

a first factor, the first factor of the first term of the first adjustment being a first constant;

a second factor, the second factor of the first term of the first adjustment being based on the error value;

a third factor, the third factor of the first term of the first adjustment being based on the first compensation parameter; and a fourth factor, the fourth factor of the first term of the first adjustment comprising a term proportional to the input control signal raised to a first power, the second adjustment comprising a first term comprising a product of:

a first factor, the first factor of the first term of the second adjustment being a second constant;

a second factor, the second factor of the first term of the second adjustment being based on the error value;

a third factor, the third factor of the first term of the second adjustment being based on the first compensation parameter; and a fourth factor, the fourth factor of the first term of the second adjustment comprising a term proportional to the input control signal raised to a second power, the second power being less than the first power.

* * * * *